US006651662B2

(12) United States Patent
Prete et al.

(10) Patent No.: US 6,651,662 B2
(45) Date of Patent: Nov. 25, 2003

(54) ALIGNMENT AND CONNECTION MECHANISM FOR A MASK-MOUNTED REGULATOR

(75) Inventors: Christopher L. Prete, Cranberry Township, PA (US); Peter V. Kling, Berlin (DE)

(73) Assignees: Mine Safety Appliances Company, Pittsburgh, PA (US); MSA Europe GmbH, Berlin (DE)

( * ) Notice: Subject to any disclaimer, the term of this patent is extended or adjusted under 35 U.S.C. 154(b) by 210 days.

(21) Appl. No.: 09/821,548

(22) Filed: Mar. 29, 2001

(65) Prior Publication Data

US 2002/0139371 A1 Oct. 3, 2002

Related U.S. Application Data

(60) Provisional application No. 60/228,088, filed on Aug. 23, 2000.

(51) Int. Cl.[7] ..... A62B 18/02

(52) U.S. Cl. ..... 128/206.21; 128/205.25

(58) Field of Search ..... 128/206.21, 205.25, 128/206.16, 206.17, 206.28; 2/171.3, 171.4, 173

(56) References Cited

U.S. PATENT DOCUMENTS

| | | | | |
|---|---|---|---|---|
| 2,951,714 A | | 9/1960 | Carlberg | |
| 4,069,516 A | | 1/1978 | Watkins, Jr. | |
| 4,841,953 A | * | 6/1989 | Dodrill | 128/202.27 |
| 5,016,627 A | | 5/1991 | Dahrendorf et al. | |
| 5,630,412 A | * | 5/1997 | Dubruille et al. | 128/206.23 |
| 5,640,952 A | * | 6/1997 | Swann et al. | 128/206.17 |
| 5,829,431 A | * | 11/1998 | Hannah et al. | 128/201.19 |
| 5,924,420 A | * | 7/1999 | Reischel et al. | 128/206.21 |
| 5,996,580 A | * | 12/1999 | Swann | 128/206.17 |

FOREIGN PATENT DOCUMENTS

| | | |
|---|---|---|
| DE | 42 26 483 | 7/1993 |
| EP | 0 090 083 | 5/1983 |
| EP | 0 394 139 | 10/1990 |
| EP | 0 878 211 | 11/1998 |
| FR | 2537695 | 6/1984 |

OTHER PUBLICATIONS

MSA Data Sheet No. 01–02–11–MC (2000) "Custom 4500 MMR and Ultralite MMR Air Masters".

* cited by examiner

*Primary Examiner*—Alfred Basichas
(74) *Attorney, Agent, or Firm*—James G. Uber

(57) ABSTRACT

An alignment and connection mechanism for more quickly attaching a mask-mounted regulator to the facepiece of a self-contained breathing apparatus is disclosed. The alignment and connection mechanism provides an alignment member preferably mounted on the regulator and a guide member preferably mounted on the facepiece. The user initially attaches the alignment member to the guide member at a connection point which is visible to the user through the lens of the facepiece when it is being worn. The regulator is then slid down the guide member until it is in proper alignment for connection to the facepiece.

18 Claims, 7 Drawing Sheets

ALIGNMENT AND CONNECTION MECHANISM FOR A MASK-MOUNTED REGULATOR

This application claims the benefit of Provisional application No. 60/228,088 filed Aug. 23, 2000.

FIELD OF THE INVENTION

The present invention relates to an alignment and connection mechanism for a mask-mounted regulator of a self-contained breathing apparatus.

BACKGROUND OF THE INVENTION

A self-contained breathing apparatus (SCBA) is a type of supplied-air respirator which permits a person to breathe in hazardous environments such as fires and confined spaces where breathing would be difficult or impossible without mechanical aid. Examples of known SCBAs are the Custom 4500® MMR and Ultralire® MMR Air Masks from Mine Safety Appliances Company ("MSA") which are shown and described in MSA Data Sheet No. 01-02-11-MC (2000), the disclosure of which is incorporated herein by reference. Typically, an SCBA includes a facepiece with a lens, a harness and carrier assembly, an air cylinder full of high pressure compressed air for breathing and at least one and preferably two air-pressure regulators. The first regulator is typically mounted on the harness and carrier assembly near the air cylinder and functions to reduce the relatively high pressure of the compressed air from the air cylinder to slightly above atmospheric pressure. The second regulator is often mounted on the facepiece and functions to adjust the flow of air to meet the respiratory needs of the user.

One such second-stage regulator is described in U.S. Pat. No. 5,016,627, the disclosure of which is incorporated herein by reference. Typically, second-stage regulators of this type are removeably mounted to the facepiece by inserting an outlet portion of the regulator into an inlet opening in the facepiece and locking the regulator in place. An example of one such second-stage regulator is the Mask-Mounted Regulator Assembly (P/N 812857) currently manufactured by MSA, which can be used with the Ultra Elite® pressure demand facepiece. As shown in the Parts List(s) and the Operation and Instructions Manual for MSA's MMR Air Masks, the disclosures of which are incorporated herein by reference, the Ultra Elite facepiece from MSA includes a lens and a component housing cover having an inlet opening in the form of a circular hole. The outer edge of the inlet hole includes two opposed outwardly extending flanges. The corresponding mask-mounted regulator assembly includes an outlet portion in the form of a circular projection which will fit inside the inlet hole. Disposed near the base of the outlet portion are a pair of slots which correspond to the two flanges on the facepiece. A projection lies within each slot and is spring-biased in the direction of the outlet portion. One of the projections is attached to a sliding release mechanism on the outside portion of the regulator. In order to connect the regulator to the facepiece, one first aligns the slots on the regulator with the flanges on the inlet hole of the facepiece. Then the circular projection of the regulator is pushed into the inlet portion of the facepiece which causes the projections to be pushed inwardly by the flanges. Finally, the regulator is rotated a quarter-turn to lock the regulator in place. In order to disconnect the regulator, the release mechanism is pulled downwardly in a direction away from the facepiece so that the regulator can be rotated a quarter-turn and the flanges on the facepiece can align with the slots on the regulator. The regulator can then be pulled away from the facepiece enabling the user to breathe ambient air through the inlet opening in the facepiece rather than compressed air from the cylinder.

One drawback to this design is that an initial visible connection point is not provided between the facepiece and the regulator when the facepiece is being worn by a user. This often results in the user having some difficulty being able to quickly connect the second-stage regulator, particularly when wearing gloves. Misalignment between the regulator and facepiece often results in several trial and error attempts to make the connection between the facepiece and the second-stage regulator. It would be desirable therefore, to provide an improved connection mechanism between the facepiece and the second-stage regulator which includes a visible initial connection point on the facepiece to enable the user to more quickly connect the regulator to the facepiece.

SUMMARY OF THE INVENTION

Generally, the present invention relates to an alignment and connection mechanism which enables a regulator to be easily and quickly connected to the facepiece of a supplied-air respirator such as an SCBA. The alignment and connection mechanism of the present invention comprises an alignment member, preferably mounted on the regulator, and a guide member, preferably mounted on the facepiece. Alternatively, the guide member could be mounted on the regulator and the alignment member could be mounted on the facepiece. In either case, the member mounted on the facepiece is at least partially visible to the user through the lens when the facepiece is being worn.

In a preferred embodiment, the alignment member comprises a pair of arm members attached to and projecting from the regulator and the guide member comprises a pair of channels formed in each side of a ridge-like projection which is attached to the component housing cover of the facepiece. The user initially attaches the pair of arm members of the regulator to the channels in the guide member, preferably at a connection point on the guide member which is visible to the user through the facepiece lens. The regulator is then slid down the channels of the guide member so that the outlet portion of the regulator is properly aligned with and swings into the inlet opening of the facepiece. The regulator is then connected to the facepiece with at least one and preferably two spring loaded hook members by pushing the regulator into the inlet opening of the facepiece. The regulator is releasable from the facepiece by pushing in on at least one and preferably two release buttons located on the regulator.

The present invention is particularly advantageous in that a visible initial connection point is provided on the facepiece which the user can easily see while wearing the facepiece. This ensures a more accurate first alignment of the regulator with the facepiece resulting in a more rapid connection. Other details, objects and advantages of the present invention will become readily apparent from the following description of the present preferred embodiment thereof.

BRIEF DESCRIPTION OF THE DRAWINGS

In the accompanying drawings, a preferred embodiment of the present invention is illustrated, by way of example only wherein.

DESCRIPTION OF THE PREFERRED EMBODIMENT

Figure 1:
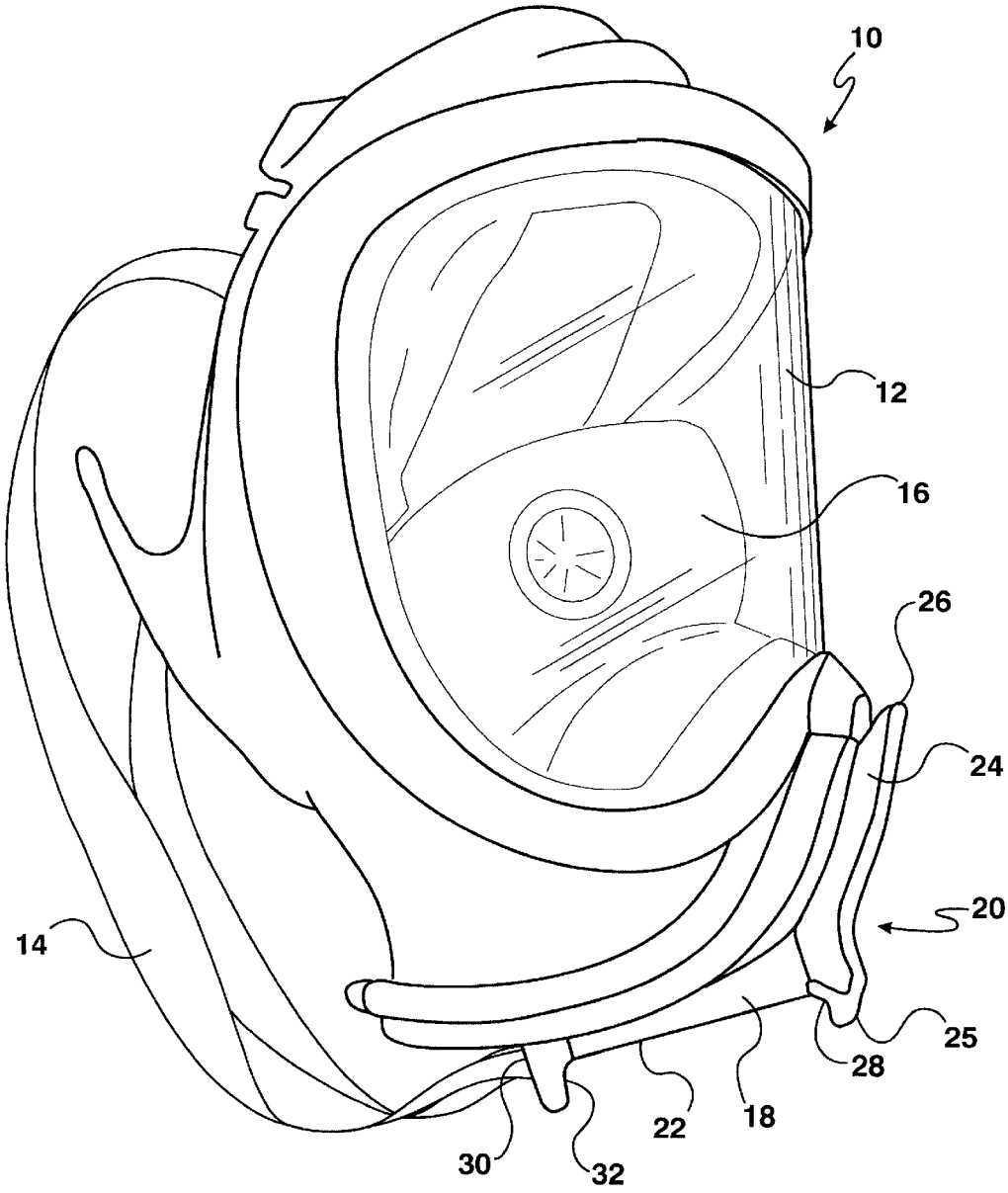
FIG. 1 is a perspective view of a preferred guide member of the present invention on an Ultra Elite facepiece.

As shown in FIG. 1, the present invention provides a facepiece 10 with a lens 12, an adjustable head harness 14, a nose cup 16 and a component housing cover 18. The component housing cover 18 is similar to the one currently used in the Ultra Elite® facepiece but it includes a guide member 20 having lateral guideways 24 on each side thereof. Preferably the guide member 20 extends from an inlet opening 22 upwardly along the contour of and past the end of the component housing cover 18. Preferably, guide member 20 is attached or connected to the component housing cover 18 substantially along its entire length. Even more preferably, guide member 20 is integrally molded with the component housing cover 18. The distal end 26 of the guide member 20 which extends past the end of the component housing cover 18 is visible by the user through the bottom portion of the facepiece lens 12 when the facepiece is being worn by the user.

Figure 4:
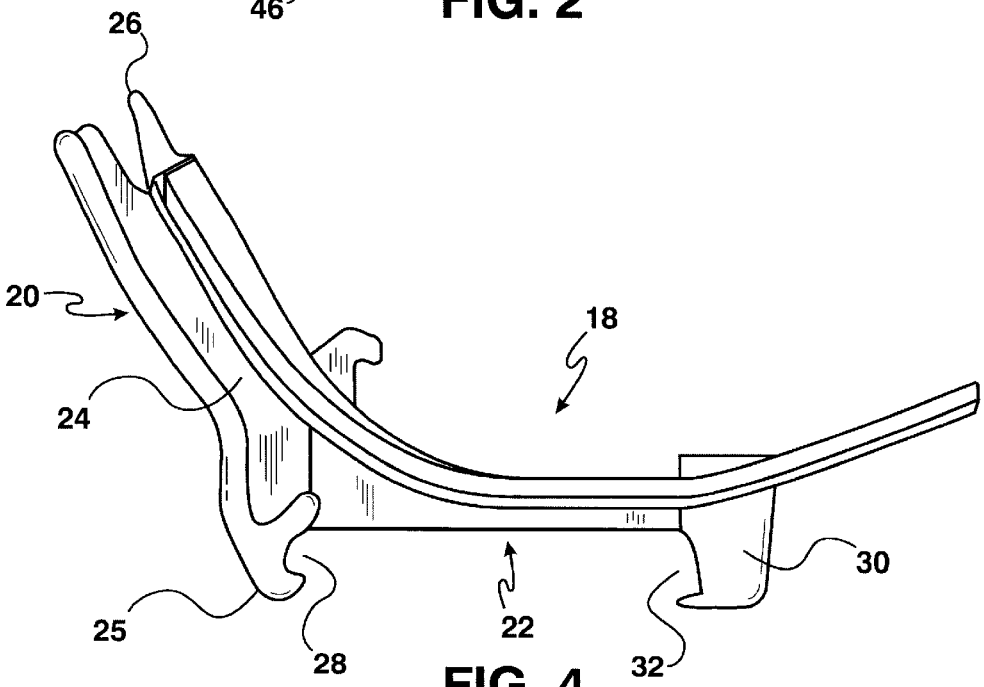
FIG. 4 is a side view of a preferred guide member forming part of the component housing cover of an Ultra Elite facepiece.

The connection mechanism between the regulator and the facepiece of the preferred embodiment of the present invention also differs from that currently used in the Ultra Elite® facepiece. As shown in FIG. 4, the proximate end 25 of the guide member 20 is preferably disposed near the inlet opening 22 and includes a first connection recess 28. A projection 30 disposed near inlet opening 22 and opposite to the guide member connection recess 28 includes a second connection recess 32.

Figure 2:
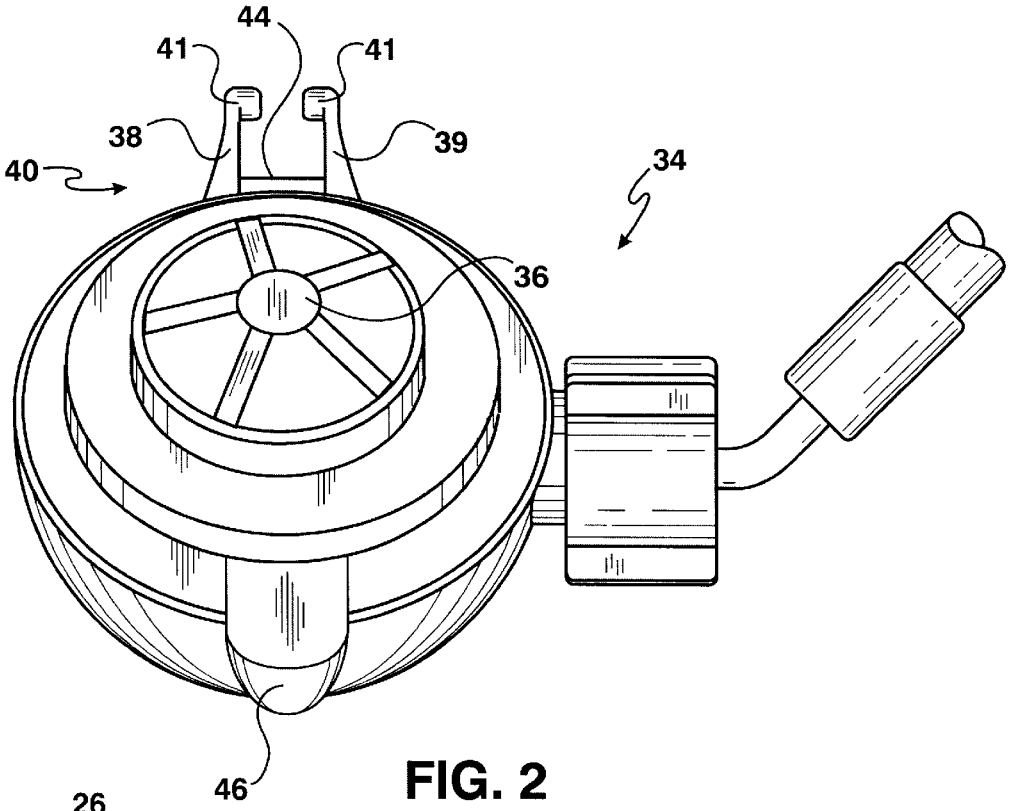
FIG. 2 is a perspective view of a mask-mounted regulator with a preferred alignment member.
Figure 3:
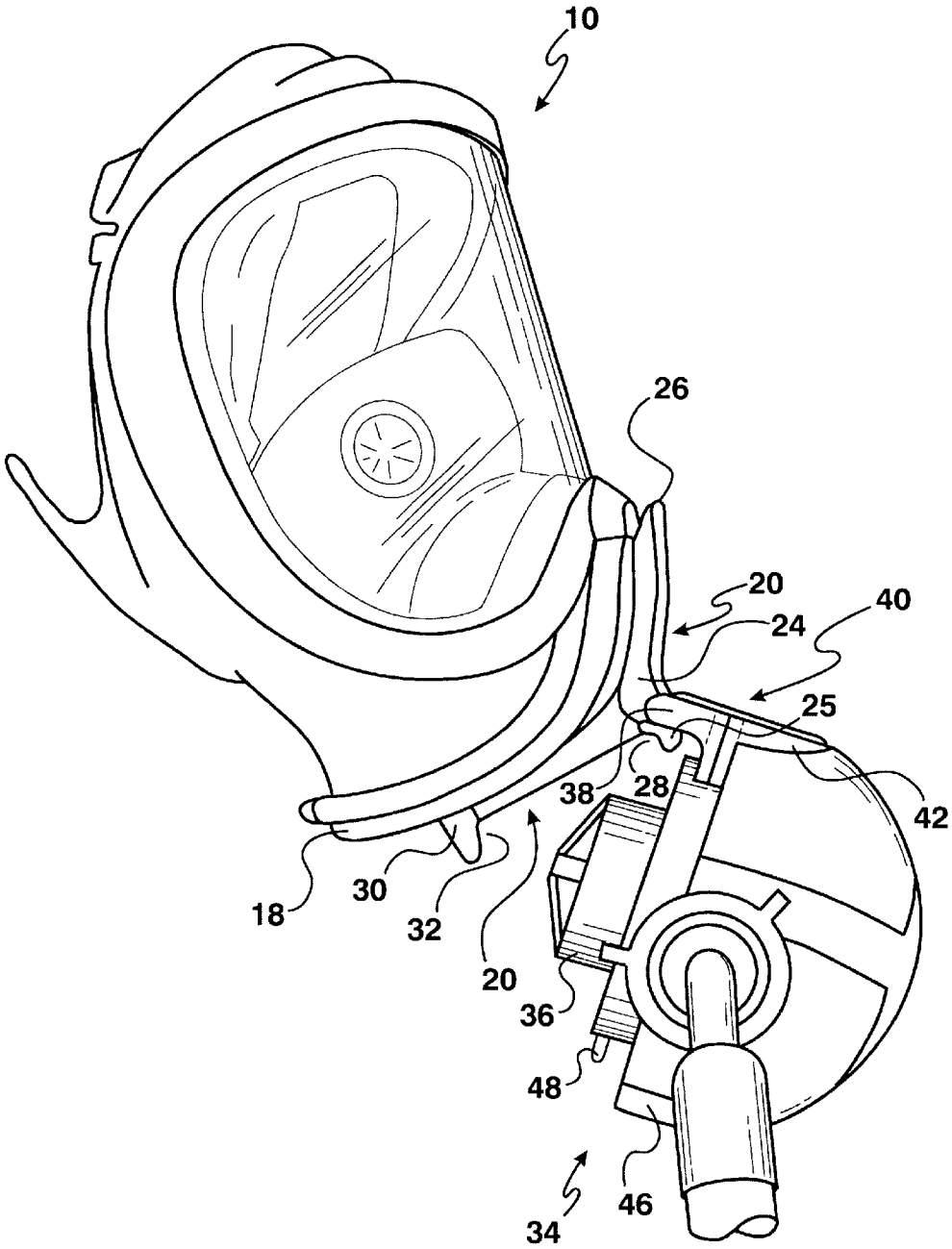
FIG. 3 shows the alignment member and regulator of FIG. 2 attached to the guide member and facepiece of FIG. 1 such that the regulator is properly aligned for connection with the facepiece.
Figure 5A:
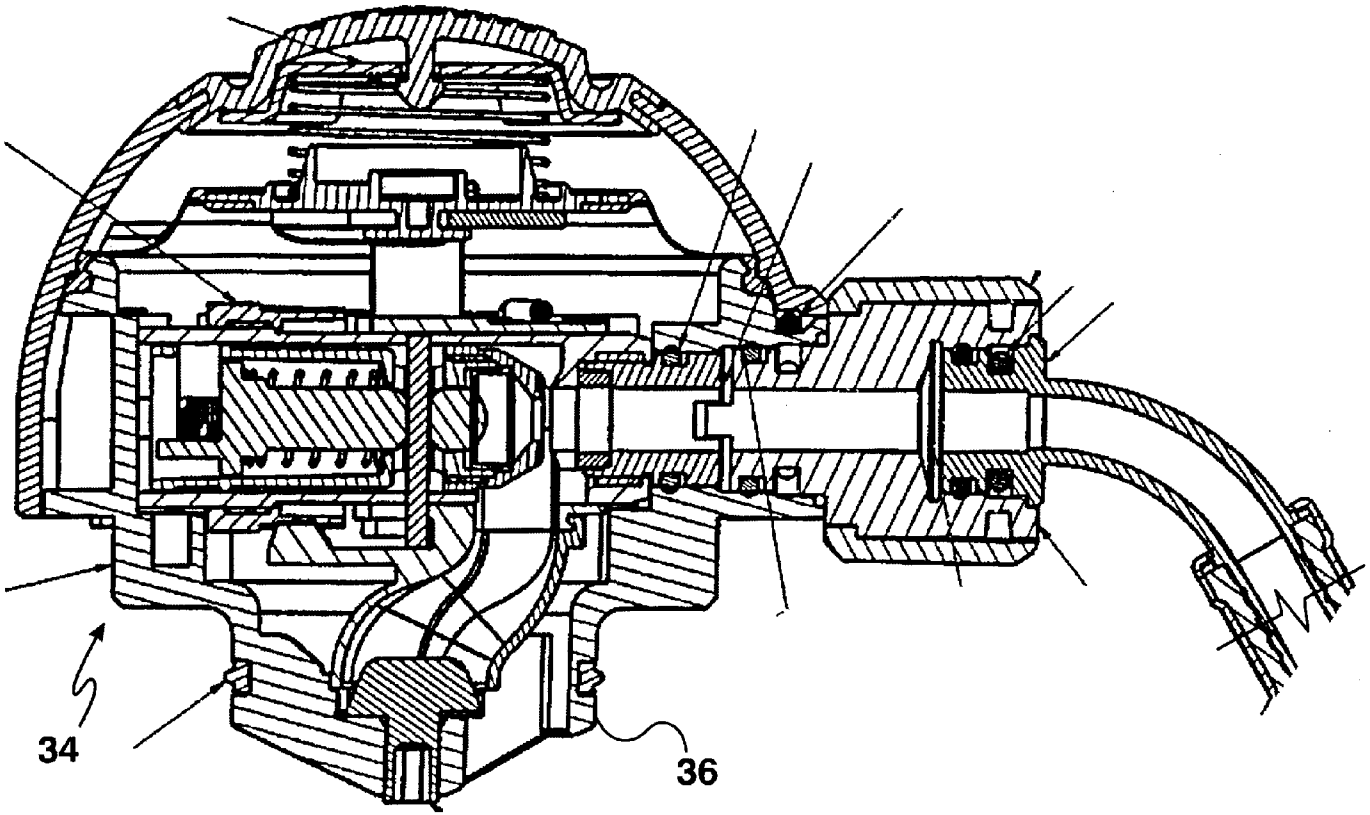
FIGS. 5A and 5B are cross-sectional side views of the second-stage regulator shown in FIG. 2.
Figure 5B:
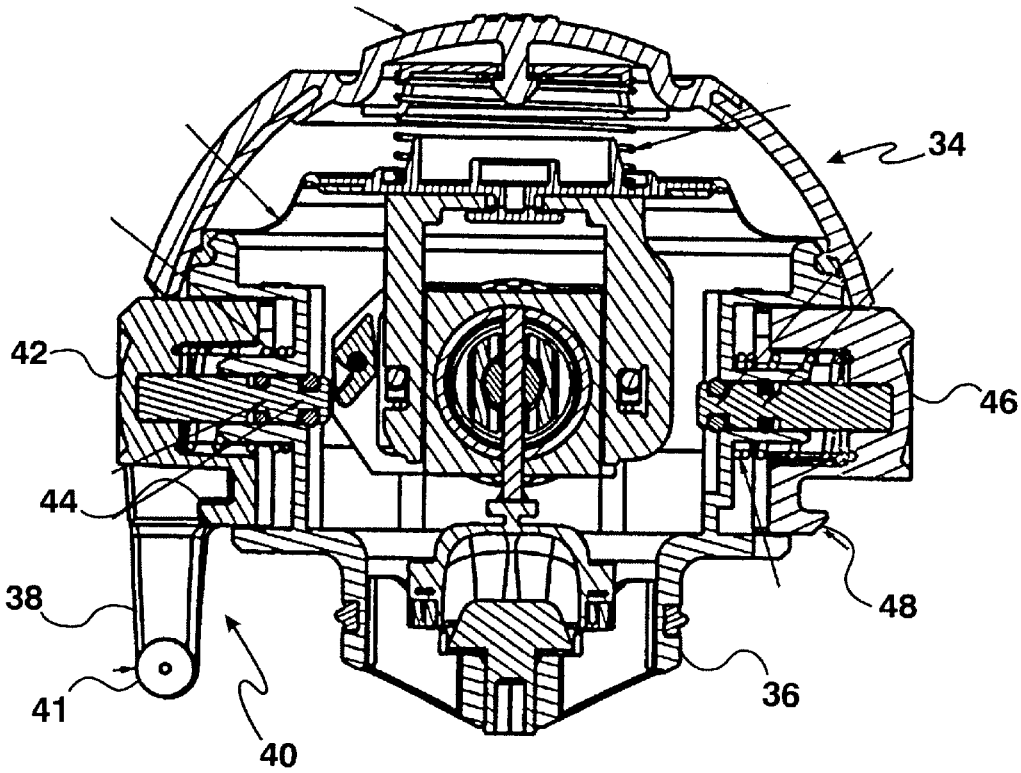

The second-stage regulator 34 is shown in detail in FIGS. 5A and 5B. It includes an outlet portion 36 and an alignment member 40 which includes a pair of extending arms 38 and 39, each having an opposed substantially hemispherical slide 41 at one end as is more clearly shown in FIG. 2. The arms form part of a first spring-biased button 42 (see FIGS. 3 and 5A) and are slightly slanted such that the slides 41 are closer together than the base of arms 38 and 39. A first hook member 44 is disposed between the base of the pair of arms 38 and 39. Opposite the first button 42 is a second spring-biased button 46 which has on it a second hook member 48. The user initially attaches the slides 41 alignment member 40 to the lateral guideways 24 of the guide member 20, preferably at the distal connection point 26 which is visible to the user through the facepiece lens 12. As is shown in FIG. 3, the regulator 34 is then slid down the lateral guideways 24 to the bottom of the guide member 20 where the regulator 34 pivots or swings into a position that is properly aligned for connection to the facepiece 10. The first and second hook members 44, 48 on the regulator lock within the first and second connection recesses 28, 32 on the facepiece. The regulator 34 is released from the facepiece 10 by pushing in the two spring-biased buttons 42, 46. While the arms 38 and 39 of the alignment member 40 can be attached to the lateral guideways 24 at any point along the guide member 20, it is the distal connection point 26 which provides the visible point of connection to the user.

Figure 6A:
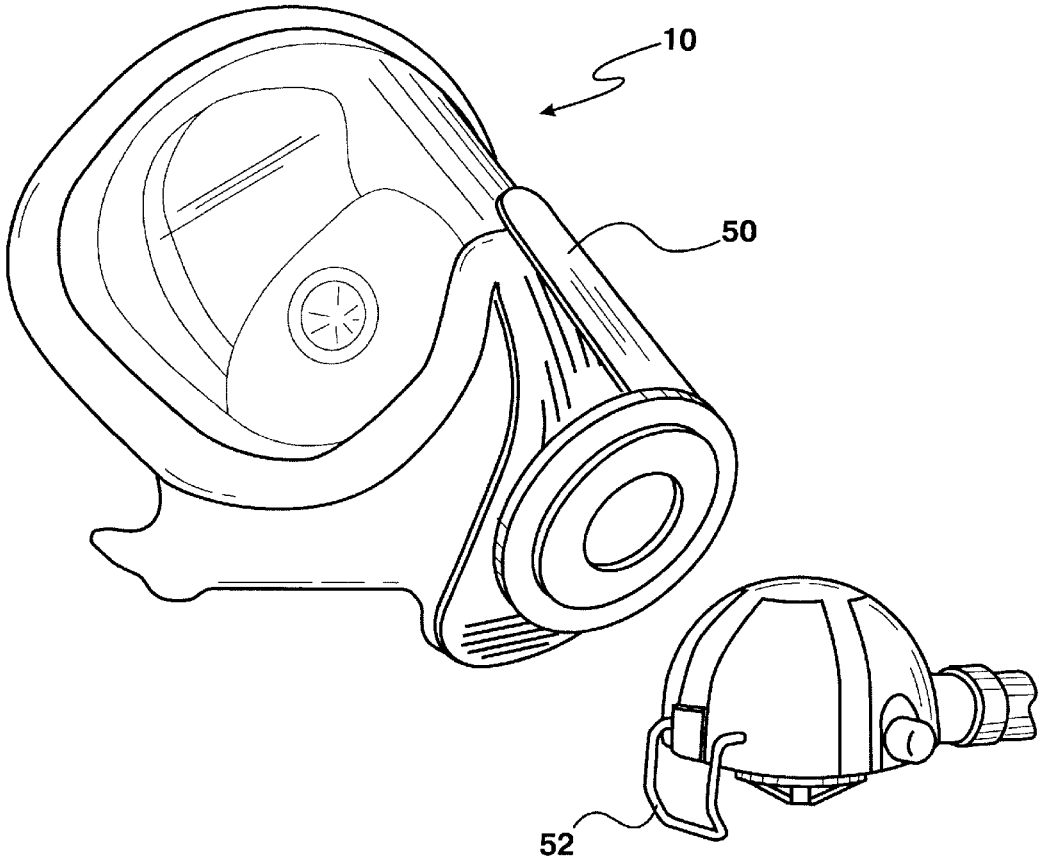
FIGS. 6A and 6B show an alternate embodiment of the alignment and connection mechanism of the present invention.
Figure 6B:
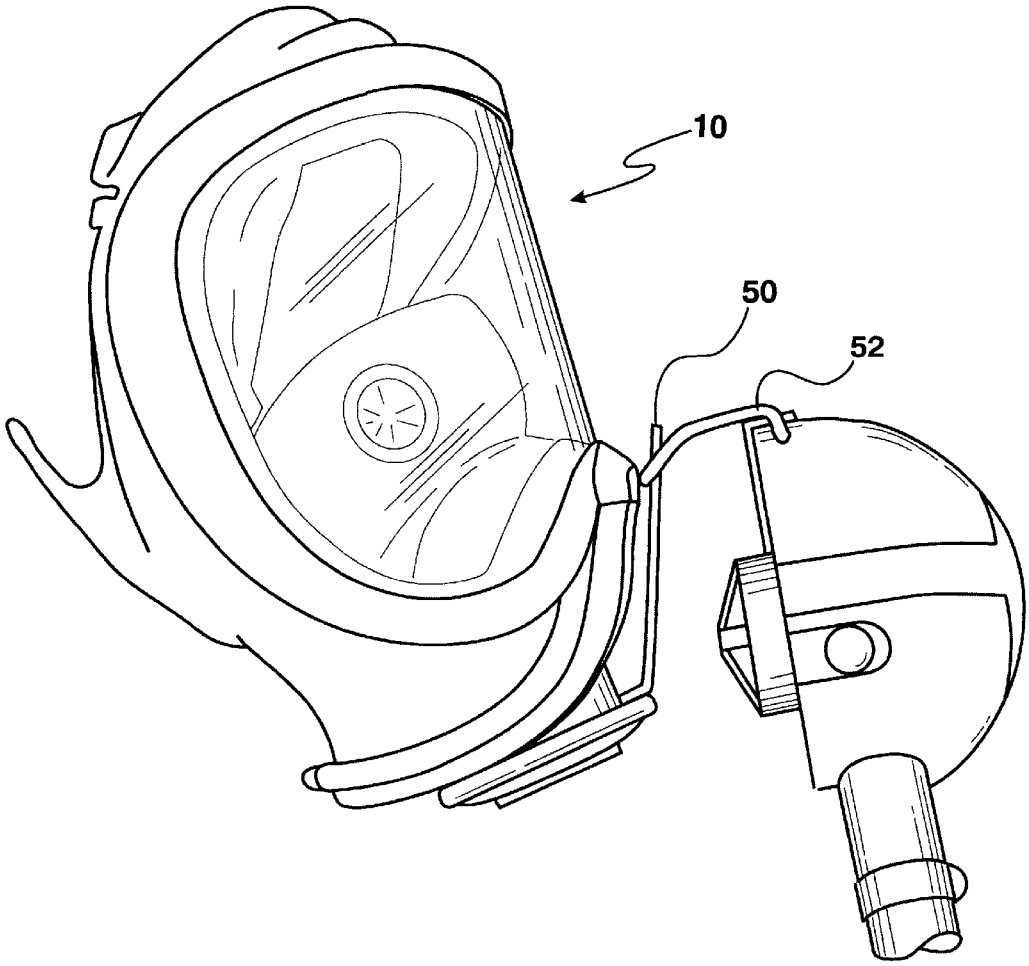

Alternatively as shown in FIGS. 6A and 6B, the guide member 50 comprises a flat, finger-like projection that is connected to the facepiece at the proximal end only with the regulator having a hook-shaped alignment member 52 which slides down the guide member 50. Other configurations of guide member and alignment member can be used to achieve the desired result of proper alignment for quick connection.

If not otherwise stated herein, it may be assumed that all components and/or processes described heretofore may, if appropriate, be considered to be interchangeable with similar components and/or processes disclosed elsewhere in the specification, unless an indication is made to the contrary. It should be appreciated that the apparatus and methods of the present invention may be configured and conducted as appropriate for the application. The embodiments described above are to be considered in all respects only as illustrative and not restrictive. The scope of the invention is defined by the following claims rather than by the foregoing description. All changes which come within the meaning and range of equivalency of the claims are to be embraced within their scope.

What is claimed is:

1. An alignment and connection mechanism for aligning and guiding a regulator to a facepiece of a supplied-air respirator during attachment:

an alignment member disposed on the regulator; and a guide member disposed on the facepiece such that a portion thereof is visible to a user through a lens of the facepiece when the facepiece is being worn by the user and wherein the alignment member attaches to the visible portion of the guide member and then slides along the guide member until the regulator is aligned with the facepiece.

2. The alignment and connection mechanism of claim 1 wherein the facepiece has an inlet opening and the regulator has an outlet portion such that the alignment member and the guide member cooperate to align the inlet opening with the outlet portion.

3. The alignment and connection mechanism of claim 2 wherein the guide member extends from the inlet opening to the lens of the facepiece.

4. The alignment and connection mechanism of claim 3 wherein the alignment member has at least one arm member which is attachable to the guide member.

5. The alignment and connection mechanism of claim 4 wherein the at least one arm member preferably comprises a pair of arm members.

6. The alignment and connection mechanism of claim 5 wherein the guide member includes a pair of guideways which receive the pair of arm members.

7. The alignment and connection mechanism of claim 6 wherein the guide member further comprises a first connection recess disposed near the inlet opening.

8. The alignment and connection mechanism of claim 7 wherein the pair of arms are preferably disposed on a first spring-biased button having a first hook member.

9. The alignment and connection mechanism of claim 8 further comprising a second connection recess disposed near the inlet opening and opposite to the first connection recess, and a second spring-biased button having a second hook member, the second spring-biased button being mounted on the regulator opposite to the first spring-biased button such that when the regulator is connected to the facepiece the first and second hook members engage the first and second connection recesses.

10. In a self-contained breathing apparatus having a facepiece with a lens and a regulator capable of being attached to the facepiece, the improvement comprising an alignment member disposed on the regulator and a guide member disposed on the facepiece such that a portion thereof is visible to a user through the lens when the facepiece is being worn by the user and wherein the alignment member attaches to the visible portion of the guide member and then slides along the guide member until the regulator is aligned with the facepiece.

11. The self-contained breathing apparatus of claim 10 wherein the facepiece has an inlet opening and the regulator has an outlet portion such that the alignment member and the guide member cooperate to align the inlet opening with the outlet portion.

12. The self-contained breathing apparatus of claim 11 wherein the guide member extends from the inlet opening to the lens of the facepiece.

13. The self-contained breathing apparatus of claim 12 wherein the alignment member has at least one arm member which is attachable to the guide member.

14. The self-contained breathing apparatus of claim 13 wherein the at least one arm member preferably comprises a pair of arm members.

15. The self-contained breathing apparatus of claim 14 wherein the guide member includes a pair of guideways which receive the pair of arm members.

16. The self-contained breathing apparatus of claim 15 wherein the guide member further comprises a first connection recess disposed near the inlet opening.

17. The self-contained breathing apparatus of claim 16 wherein the pair of arms are preferably disposed on a first spring-biased button having a first hook member.

18. The self-contained breathing apparatus of claim 17 further comprising a second connection recess disposed near the inlet opening and opposite to the first connection recess, and a second spring-biased button having a second hook member, the second spring-biased button being mounted on the regulator opposite to the first spring-biased button, such that when the regulator is connected to the facepiece the first and second hook members engage the first and second connection recesses.

* * * * *